US008764610B2

(12) United States Patent
Chen et al.

(10) Patent No.: US 8,764,610 B2
(45) Date of Patent: Jul. 1, 2014

(54) TRAMPOLINE EQUIPPED WITH A PROTECTIVE CIRCULAR NET

(75) Inventors: Sam Sheng Chen, Shanghai (CN); Hua-Lu Hsiang, Taoyuan (TW)

(73) Assignee: Crowntec Fitness Mfg., Ltd., Taoyuan (TW)

( * ) Notice: Subject to any disclaimer, the term of this patent is extended or adjusted under 35 U.S.C. 154(b) by 148 days.

(21) Appl. No.: 13/416,977

(22) Filed: Mar. 9, 2012

(65) Prior Publication Data

US 2013/0005537 A1 Jan. 3, 2013

(30) Foreign Application Priority Data

Jul. 1, 2011 (CN) ..... 2011 2 0239390 U

(51) Int. Cl.
*A63B 21/00* (2006.01)

(52) U.S. Cl.
USPC ..... 482/27; 482/28; 482/35; 5/233; 5/189

(58) Field of Classification Search
USPC ..... 482/27, 28, 29, 35, 24; 5/223, 189
See application file for complete search history.

(56) References Cited

U.S. PATENT DOCUMENTS 7,611,443 B2 * 11/2009 Publicover ..... 482/27
7,766,795 B2 8/2010 Publicover
7,850,575 B1 * 12/2010 Hsiang ..... 482/27
8,430,795 B2 * 4/2013 Publicover et al. ..... 482/27
2005/0037896 A1 * 2/2005 Publicover ..... 482/27
2006/0058157 A1 * 3/2006 Greiner et al. ..... 482/27
2013/0109639 A1 * 5/2013 Hughes et al. ..... 514/26

FOREIGN PATENT DOCUMENTS

TW M388359 U1 9/2010

* cited by examiner

*Primary Examiner* — Jerome W Donnelly

(74) *Attorney, Agent, or Firm* — Muncy, Geissler, Olds & Lowe, P.C.

(57) ABSTRACT

A trampoline includes a frame, a protective circular net and a jumping portion. The frame has a circular base rack, a plurality of legs and circular net support racks respectively at two sides of the circular base rack. The jumping portion is located in the circular base rack and includes a flexible mat and a plurality of elastic support members having one end coupled on the flexible mat and another end fastened to the circular base rack. The protective circular net is hung on the circular net support racks. The protective circular net is held by a reinforced coupling portion which includes a holding section fastened to the flexible mat and a retaining section threaded through by at least one tightening member. The protective circular net has a lower edge with a plurality of apertures formed thereon threaded through by the tightening member to couple with the retaining section.

5 Claims, 5 Drawing Sheets

TRAMPOLINE EQUIPPED WITH A PROTECTIVE CIRCULAR NET

FIELD OF THE INVENTION

The present invention relates to a trampoline equipped with a protective circular net and particularly to a trampoline equipped with a protective circular net positioning structure.

BACKGROUND OF THE INVENTION

People nowadays, after having enjoyed material affluence, have growing care about activities related to higher life quality such as leisure, exercises and sports. Modern people commonly do not have sufficient exercises or exercise space. Hence a wide variety of exercise facilities and equipment have been developed that are easy to use without occupying too much space.

For instance, Taiwan patent M388359 discloses a "folding trampoline" which includes a frame, two hinge structures, a plurality of elastic support members and a jumping pad. The frame can be disassembled into a first, second, third and fourth side frames. The first and second side frames and third and fourth side frames have respectively two ends formed a hinged end with apertures formed thereon hinged by a pin. The hinge structures are located between the hinged ends of the first and second side frame and third and fourth side frames. The elastic members are located on an inward arched end of the frame with a hook end at one side anchored by the pin and a latch end at another side. The jumping pad is surrounded by the frame and latched by the latch end of the elastic members on the circumference for positioning. Thus it has the jumping pad held in the center of the frame and elastic members to bridge the jumping pad and frame to provide rebounding elastic forces from the jumping pad during jumping of a user.

In order to protect user's safety, many present trampolines include a safety net to keep the user from being thrown outside by the rebounding forces. For instance, U.S. Pat. No. 7,766,795 discloses a trampoline system which includes a circular frame supported by a plurality of legs and connected to a mat via a plurality of spring members, and an elastic mesh type cylindrical wall mounted onto the frame to prevent users from being thrown outside the trampoline by the rebounding force.

However, U.S. Pat. No. 7,766,795 has significant gaps between the circular wall and mat, and no fastening and positioning structure is formed between them. When a user jumps onto the mat, the gaps become bigger due to up and down movements, and the user could still be incidentally thrown outside the mat and hurt. Hence the safety means thus formed still leaves a lot to be desired, and there is room for improvement.

SUMMARY OF THE INVENTION

In view of the conventional trampolines do not have sufficient holding capability between the jumping mat and protective mesh, and greater gaps are formed between the jumping mat and protective mesh that result in safety deficiency, the primary object of the present invention is to provide an improved trampoline with enhanced positioning between the protective mesh and jumping mat to improve safety when in use.

The present invention provides a trampoline equipped with a protective circular net that includes a frame, a protective circular net and a jumping portion. The frame has a circular base rack, a plurality of legs and a plurality of circular net support racks respectively at two sides of the circular base rack. The jumping portion is located in the circular base rack and includes a flexible mat and a plurality of elastic support members having one end coupled on the flexible mat and another end fastened to the circular base rack. The protective circular net is hung on the circular net support racks. In order to securely hold the protective circular net, the invention further has a reinforced coupling portion which includes a holding section fastened to the flexible mat and a retaining section threaded through by at least one tightening member. The protective circular net has a lower edge with a plurality of apertures formed thereon threaded through by the tightening member to connect to the retaining section. The reinforced coupling portion can enhance positioning of the protective circular net to prevent user's limbs from inadvertently treading through gaps between the jumping pad and protective circular net and getting hurt.

More specifically, the flexible mat includes a central portion and a protective pad covering the elastic support members. The central portion is coupled with a plurality of latch portions latched on the elastic support members for positioning. The reinforced coupling portion can be selectively connected to the central portion or the protective pad via the holding section. The protective circular net has a lower edge pendent with a plurality of holes formed thereon threaded through by the tightening member. The tightening member can be a rope.

Through the features set forth above, the protective circular net and reinforced coupling portion are fastened tightly via the tightening member, thereby the gaps between the jumping portion and protective circular net are prevented from becoming too big and safety concern can be eliminated.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
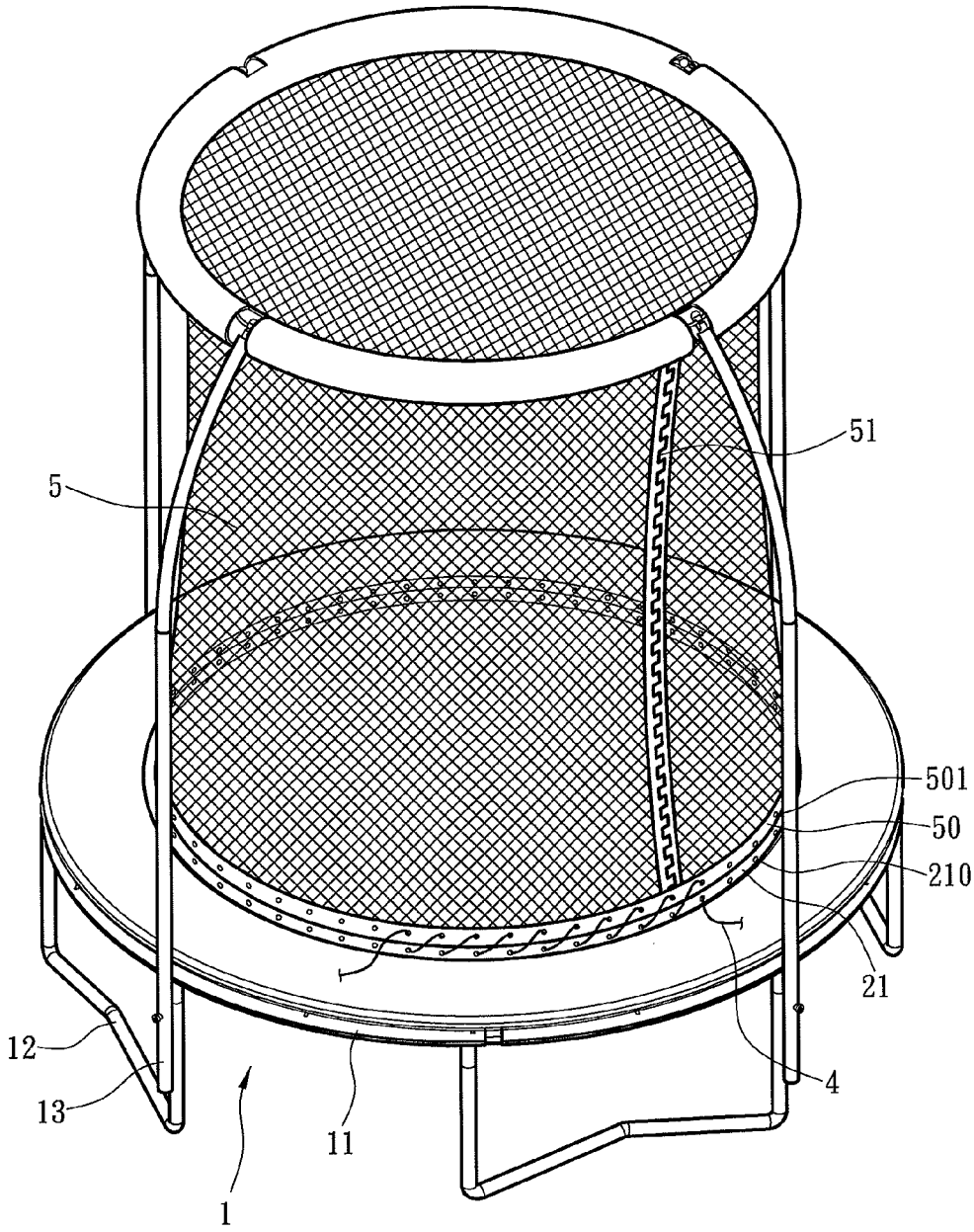
FIG. 1 is a perspective view of a first embodiment of the trampoline of the invention.
Figure 2:
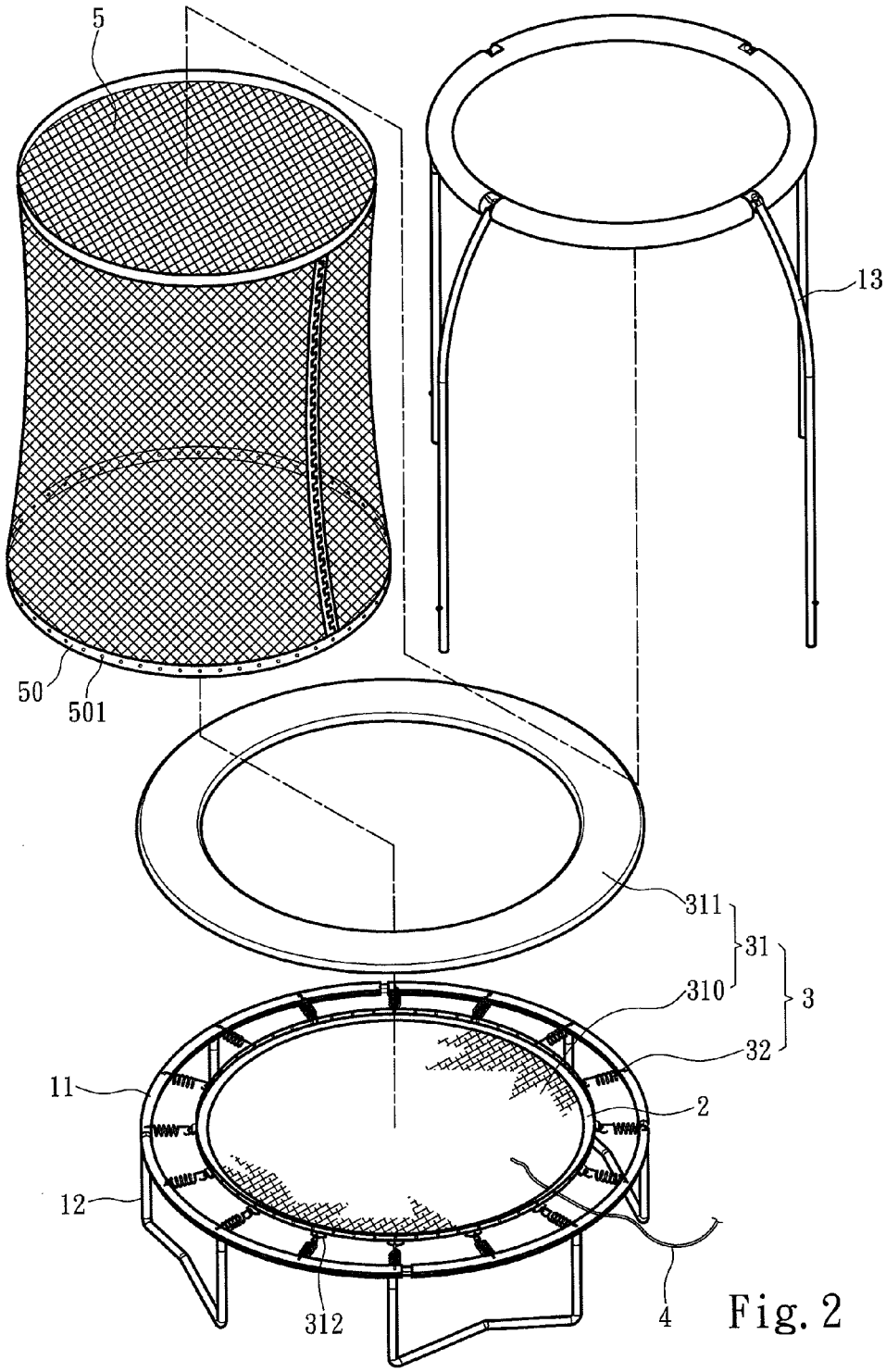
FIG. 2 is an exploded view of the first embodiment of the invention
Figure 3:
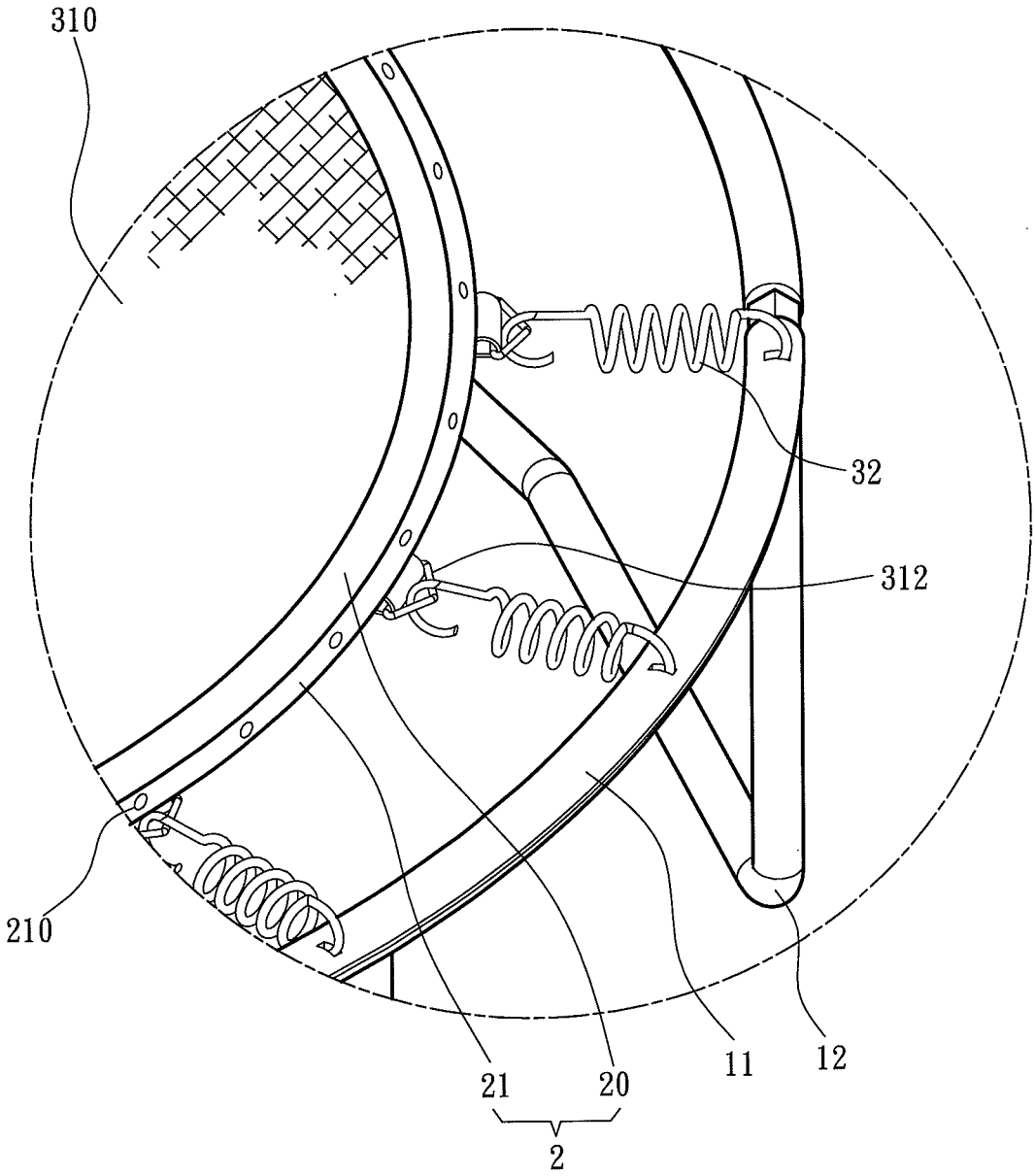
FIG. 3 is a fragmentary enlarged view of the first embodiment showing the central portion and circular base rack.
Figure 4:
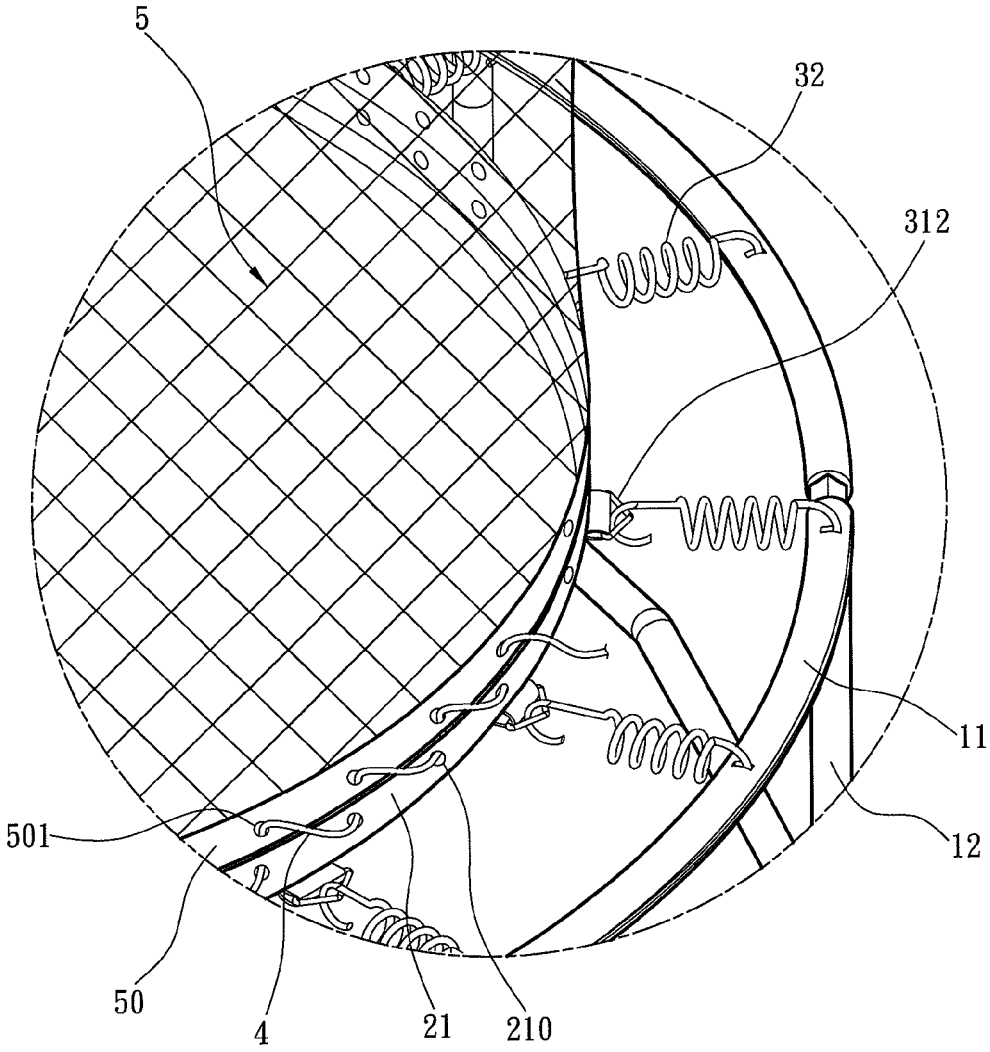
FIG. 4 is another fragmentary enlarged view of the first embodiment showing the central portion and circular base rack.

The present invention aims to provide a trampoline equipped with a protective circular net. Please refer to FIGS. 1 and 4 for a first embodiment of the invention. The trampoline includes a frame 1, a jumping portion 3 and a protective circular net 5. The frame 1 has a circular base rack 11, a plurality of legs 12 and a plurality of circular net support racks 13 respectively at two sides of the circular base rack 11. The legs 12 raise the circular base rack 11 from the ground surface. The circular net support racks 13 are extended upwards higher than the circular base rack 11. The protective circular net 5 has an upper end hung on the circular net support racks 13 and other portions pendent freely around the circular base rack 11, and also has a lower edge formed a plurality of apertures 501. The lower edge of the protective circular net 5 may also be stitched to a lower hem 50 with the apertures 501 formed thereon. Use of the apertures 501 will be discussed later. To facilitate user's entry and exit the protective circular net 5 has an opening 51 formed thereon which can be attached with a fastener as desired, such as latch buttons or a zipper. Design of the opening 51 forms no part of the invention, thus details are omitted, and the invention also does not impose the types of applicable opening 51. The jumping portion 3 includes a flexible mat 31 and a plurality of elastic support members 32 each has one end coupled on the flexible mat 31. Each elastic support member 32 has another end fastened to the circular base rack 11. After a user has entered the protective circular net 5, he/she can jump on the jumping portion 3. The elastic support members 32 provide rebounding elastic forces for the flexible mat 31. To avoid the user from skewing during jumping and jumping outside the protective circular net 5 the invention further includes a reinforced coupling portion 2 which includes a holding section 20 fastened to the flexible mat 31 and a retaining section 21 threaded through by at least one tightening member 4. The holding section 20 is fixedly fastened to the flexible mat 31 by stitching or adhesive bonding, but this is not the limitation of the invention. The retaining section 21 has a plurality of holes 210 threaded through by the tightening member 4 which can be a rope. More specifically, the flexible mat 31 includes a central portion 310 and a protective pad 311 covering the elastic support members 32. The central portion 310 is coupled with a plurality of latch portions 312 latched on the elastic support members 32 for positioning. In the first embodiment the holding section 20 can be selectively located on the circumference of the central portion 310. While the retaining section 21 is coupled with the holding section 20, it is not directly fastened to the central portion 310, rather movably coupled with the central portion 310 via the holding section 20. When the protective circular net 3 is hung on the circular net support rack 13 and pendent naturally, the lower hem 50 is proximate to the retaining section 21, then the tightening member 4 can be threaded through the apertures 501 and holes 210 to tighten the protective circular net 5 and retaining section 21, thus the protective circular net 5 can be held securely via the tightening member 4 without flapping irregularly. Moreover, the lower hem 50 and the retaining section 21 form a smaller gap between them. As the tightening member 4 is threaded between the apertures 501 and holes 210 of the protective circular net 5 and retaining section 21, user's limbs can be prevented from running through the gap between the lower hem 50 and retaining section 21, thus improved safety protection can be achieved.

Figure 5:
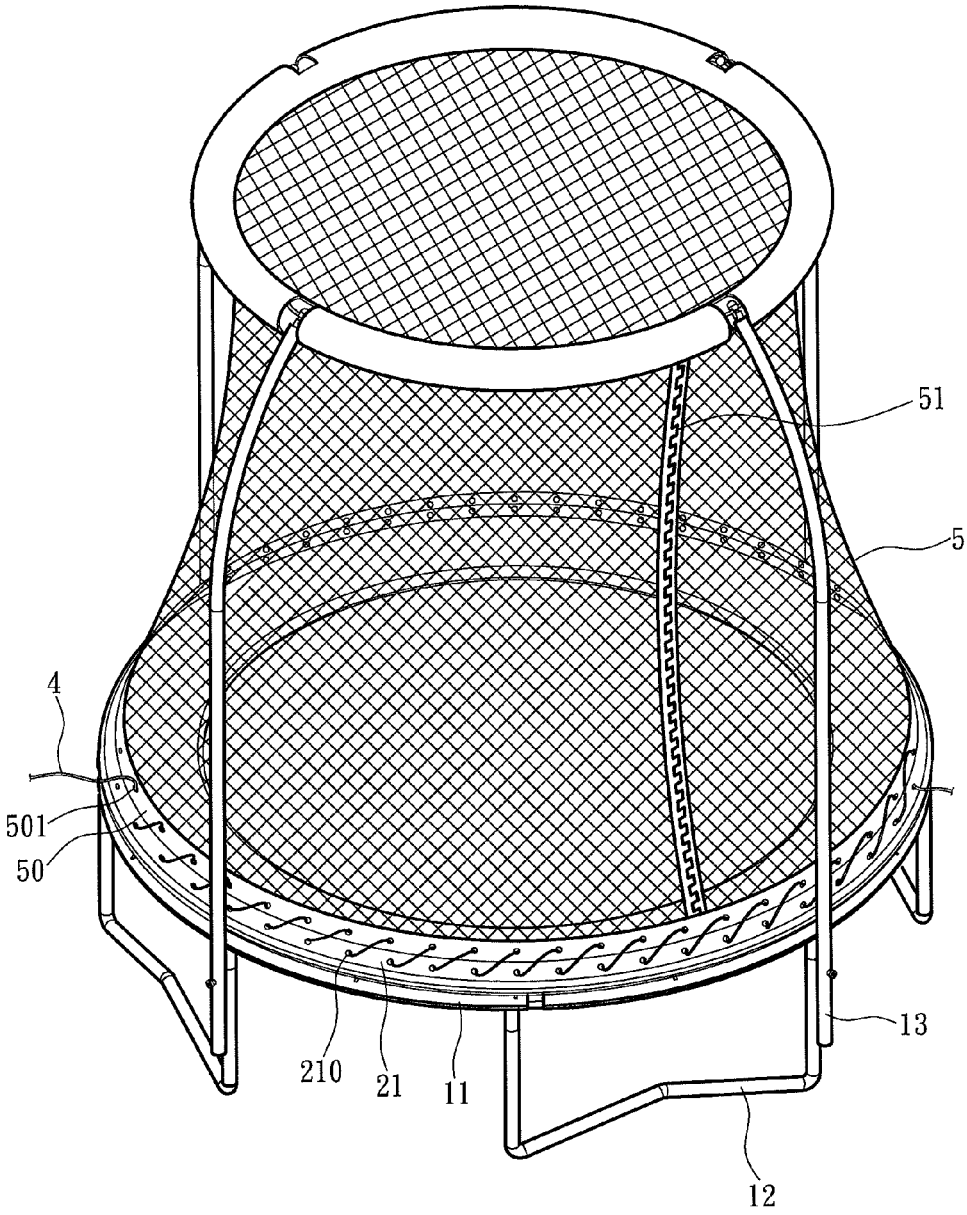
FIG. 5 is a schematic view of a second embodiment of the trampoline of the invention.

Please refer to FIG. 5 for a second embodiment of the invention. As previously discussed, the flexible mat 31 is divided into the central portion 310 and protective pad 311 covering the elastic support members 32 to prevent hurting the user. In the second embodiment the holding section 20 of the reinforced coupling portion 2 is fastened to the protective pad 311, and the retaining section 21 can be moved outwards to further extend the protective circular net 5 to increase the jumping space surrounded by protective circular net 5 for the user.

In short, by means of the aforesaid features, the protective circular net 5 and reinforced coupling portion 2 are tightly fastened via the tightening member 4, thus can prevent forming too large gap between the jumping portion 3 and protective circular net 5, and improve safety.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A trampoline equipped with a protective circular net, comprising:

a frame including a circular base rack, a plurality of legs and a plurality of circular net support racks respectively located at two sides of the circular base rack;

a jumping portion which is located in the circular base rack and includes a flexible mat and a plurality of elastic support members having one end coupled on the flexible mat and another end fastened to the circular base rack;

a reinforced coupling portion including a holding section fastened to the flexible mat and a retaining section threaded through by at least one tightening member; and a protective circular net which is hung on the circular net support racks and includes a lower edge formed a plurality of apertures threaded through by the tightening member to couple with the retaining section.

2. The trampoline of claim 1, wherein the flexible mat includes a central portion and a protective pad covering the elastic support members, the central portion including a plurality of latch portions latched on the elastic support members for positioning.

3. The trampoline of claim 2, wherein the holding section of the reinforced coupling portion is coupled on the central portion.

4. The trampoline of claim 2, wherein the holding section of the reinforced coupling portion is coupled with the protective pad.

5. The trampoline of claim 1, wherein the tightening member is a rope.

* * * * *